US010603782B2

(12) United States Patent
Reinhart

(10) Patent No.: US 10,603,782 B2
(45) Date of Patent: Mar. 31, 2020

(54) INTEGRATED TRACK AND SUPPORT SYSTEM

(71) Applicant: Creative Plastic Concepts, LLC, Sycamore, OH (US)

(72) Inventor: Nickolas Reinhart, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 159 days.

(21) Appl. No.: 15/161,717

(22) Filed: May 23, 2016

(65) Prior Publication Data

US 2016/0346912 A1 Dec. 1, 2016

Related U.S. Application Data

(60) Provisional application No. 62/168,209, filed on May 29, 2015.

(51) Int. Cl.
*B25H 1/06* (2006.01)
*B25H 1/14* (2006.01)

(52) U.S. Cl.
CPC ..... *B25H 1/06* (2013.01); *B25H 1/14* (2013.01)

(58) Field of Classification Search
None
See application file for complete search history.

(56) References Cited

U.S. PATENT DOCUMENTS

| | | | | | |
|---|---|---|---|---|---|
| 2,256,892 | A | * | 9/1941 | Burman | A47B 91/024 16/29 |
| 3,185,470 | A | * | 5/1965 | Zitner | B23Q 3/06 144/117.1 |
| 4,170,345 | A | * | 10/1979 | Townsend | B25H 1/08 269/203 |
| 5,592,981 | A | * | 1/1997 | Derecktor | B25H 1/06 144/286.1 |
| 5,904,225 | A | * | 5/1999 | Patros | B25H 1/08 182/181.1 |
| D722,183 | S | | 2/2015 | Reinhart | |

OTHER PUBLICATIONS

Lee Valley, Apr. 12, 2015, found at https://web.archive.org/web/20150412073006/http://www.leevalley.com/us/Wood/page.aspx?cat=1,43455&p=66239, attached as pdf (Year: 2015).*

Amazon Sliding Fastener, found at https://web.archive.org/web/20150224094934/http://www.amazon.com/1-4-20-Oval-Nut-10-pack/dp/B0036B2NL4, attached as pdf, pub Feb. 2015 (Year: 2015).*

* cited by examiner

*Primary Examiner* — Brian D Keller
(74) *Attorney, Agent, or Firm* — Jacob M. Ward; Ward Law Office LLC

(57) ABSTRACT

A support system has a main body with a plurality of legs attached to a support portion. The support portion has an integrated track disposed therein. The integrated track is defined by an elongate cavity disposed through a length of the support portion. The integrated track is either molded into the support portion or defined by a metal channel disposed in the support portion. The integrated track can receive a rotatable rail, for creating a work surface. The integrated track may also receive one or more work implements.

9 Claims, 11 Drawing Sheets

INTEGRATED TRACK AND SUPPORT SYSTEM

CROSS REFERENCE TO RELATED APPLICATIONS

This application claims the benefit of U.S. Provisional Application Ser. No. 62/168,209, filed on May 29, 2015. The entire disclosure of the above application is hereby incorporated herein by reference.

FIELD

The present invention relates to support systems, and more particularly, to sawhorses, work benches, trestles, tables, and related structures.

BACKGROUND

Support systems such as sawhorses have long been used in the construction trade, providing a beam with four legs used to support construction materials for sawing. A pair of sawhorses can support a plank, providing an easily made scaffold. Two sawhorses can also be used to easily form a work surface, through placement of a sheet of plywood or door on top thereof.

Typical sawhorses can be easily constructed in the field, by attaching a cross beam between the two sets of legs. However, the structural integrity of such sawhorses is directly related to the skill with which the various members are attached together.

Increased confidence is frequently obtained through the use of pre-formed molded plastic sawhorses, having both plastic legs and a cross beam. Some of these sawhorses are provided with pivoting legs, which advantageously permit the sawhorses to be collapsed when in storage or transit.

There is a continuing need for a support system such as a pre-formed plastic sawhorse with an integrated track that facilitates a more efficient connecting of multiple sawhorses, to form work surfaces of different sizes and shapes. Desirably, the integrated track is easily storable together with the sawhorse when collapsed, and also permits the use of a variety of work implements.

SUMMARY

In concordance with the instant disclosure, a support system such as a pre-formed plastic sawhorse with an integrated track that facilitates a more efficient connecting of multiple sawhorses, to form work surfaces of different sizes and shapes, and which integrated track is easily storable together with the sawhorse when collapsed, and which also permits the use of a variety of work implements, is surprisingly discovered.

In one embodiment, a support system includes a main body having a plurality of legs attached to a support portion. The support portion has an integrated track disposed therein. The integrated track is defined by an elongate cavity disposed through a length of the support portion. The cavity may either be molded into the support portion or defined by an elongate metal insert disposed in the support portion. In certain embodiments, the cavity is substantially t-shaped in cross-section.

In another embodiment, a rotatable rail is slidably received by the integrated track of the support system. The rotatable rail has an insert portion and a rotatable portion. In operation, the insert portion is disposed in the elongate cavity of the integrated track. The rotatable portion is disposed above the track and is configured to rotate relative to the insert portion of the rotatable rail.

In a further embodiment, at least one of the legs of the main body has a recess configured to receive the rotatable rail for storage or transport. The recess of the leg may have at least one attachment structure configured to removably secure the rail to the leg.

DRAWINGS

The above, as well as other advantages of the present disclosure, will become readily apparent to those skilled in the art from the following detailed description, particularly when considered in the light of the drawings described hereafter.

Figure 18:
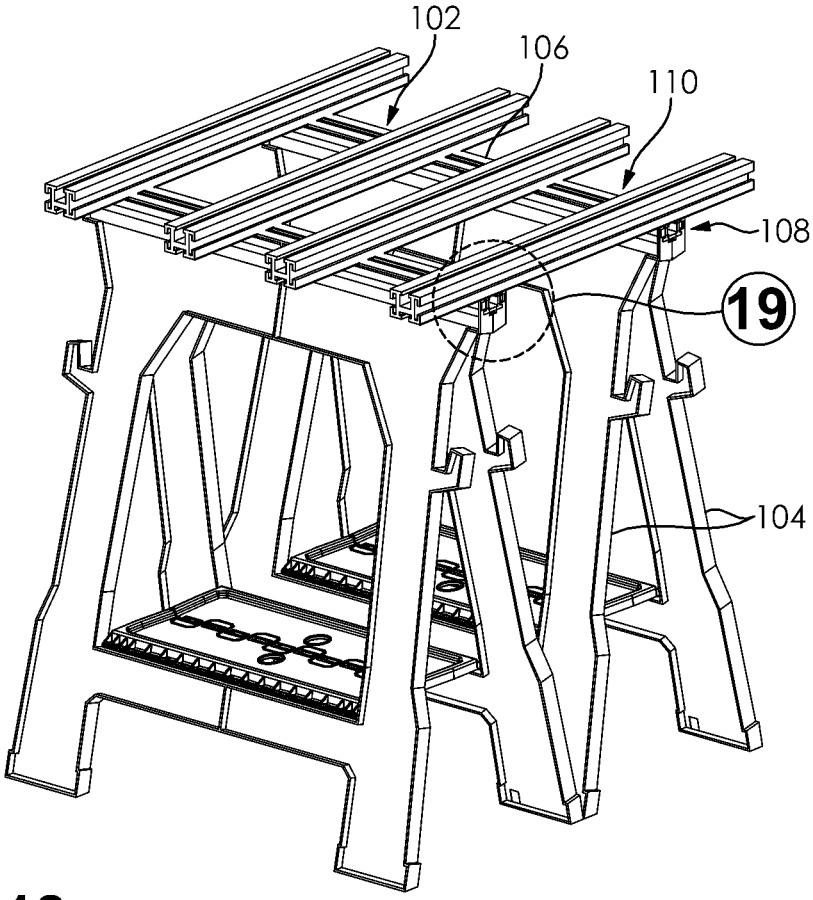
FIG. 18 is a perspective view showing a plurality of the support systems according to another embodiment of the present disclosure, the rotatable rails of the support systems cooperating with different ones of the support systems to form a work surface.
Figure 19:
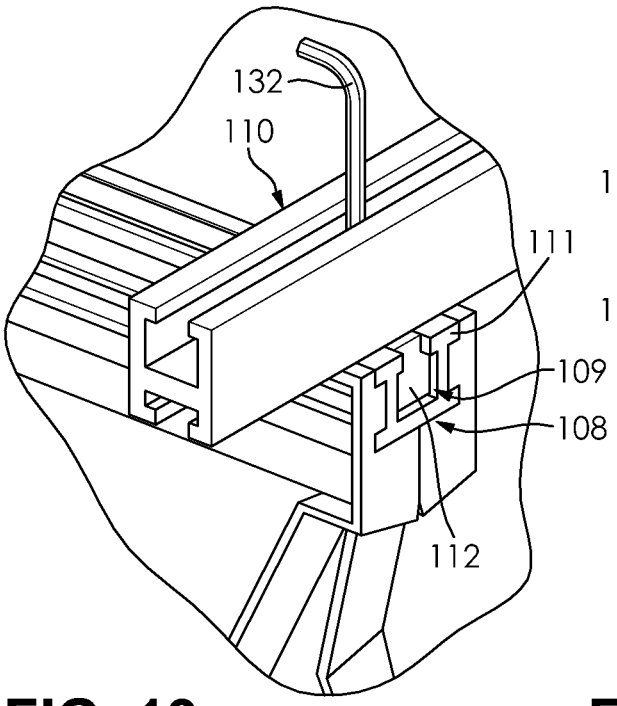
FIG. 19 is an enlarged perspective view of one of the support systems taken at callout 19 in FIG. 18.
Figure 20:
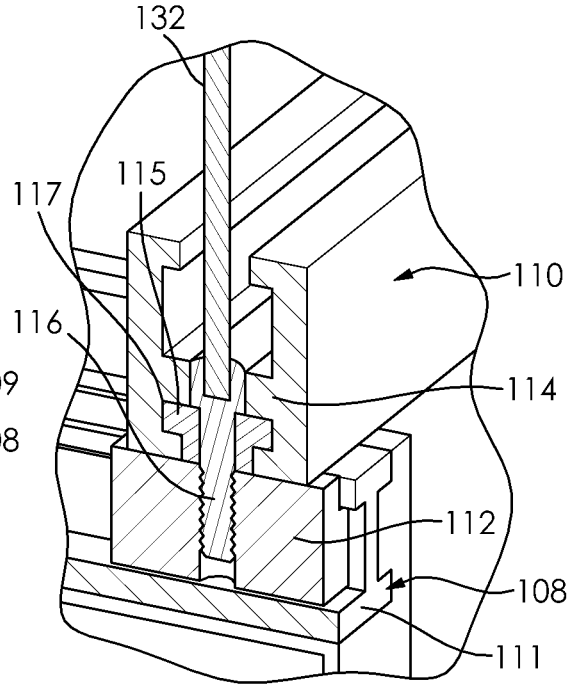
FIG. 20 is an enlarged cross-sectional perspective view of the support system shown in FIG. 19.
Figure 21:
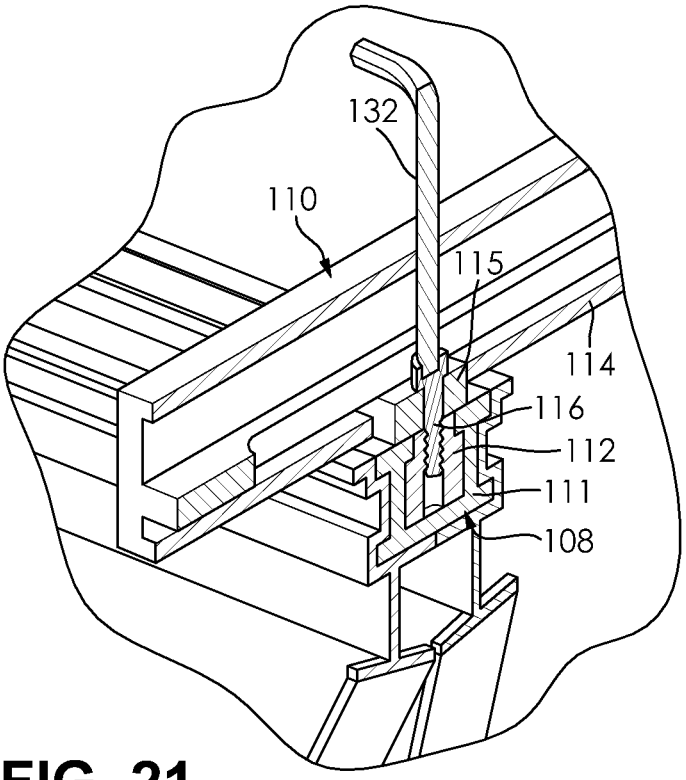
FIG. 21 is another enlarged cross-sectional perspective view of the support system shown in FIG. 19.
Figure 22:
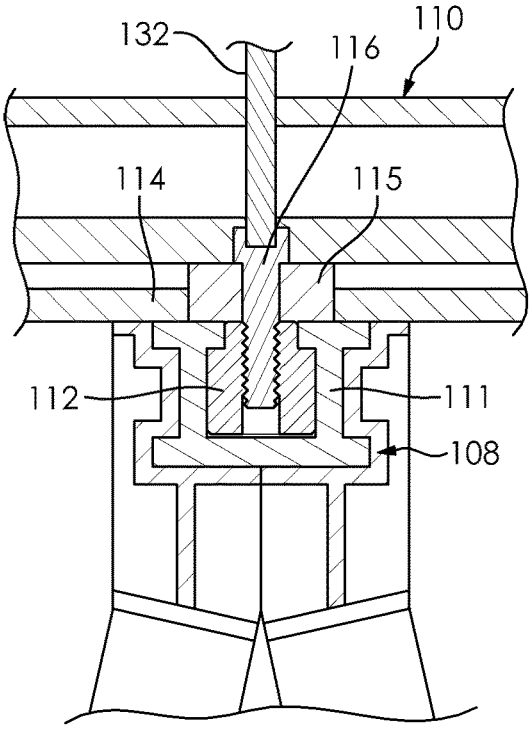
FIG. 22 is an enlarged cross-sectional side elevational view of the support system shown in FIG. 21.
Figure 23:
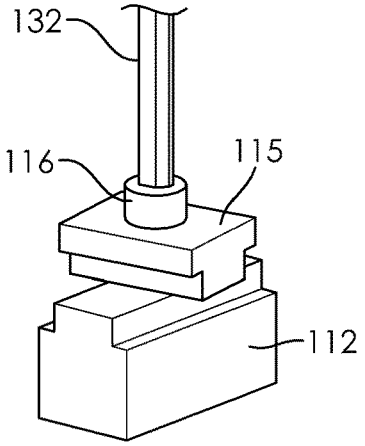
FIG. 23 is an enlarged perspective view of an insert portion of a rotatable rail of the support system shown in FIGS. 18-22.
Figure 24:
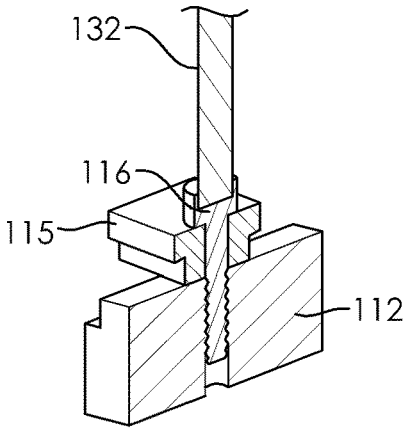
FIG. 24 is an enlarged cross-sectional perspective view of the insert portion of the rotatable rail of the support system shown in FIG. 23.
Figure 25:
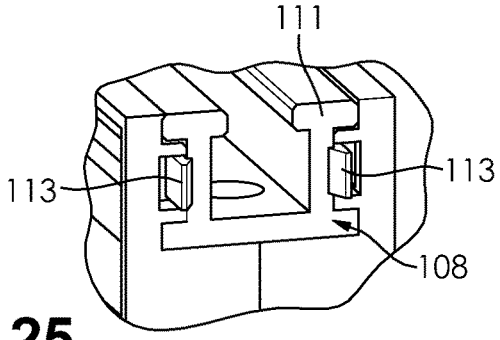
Figure 26:
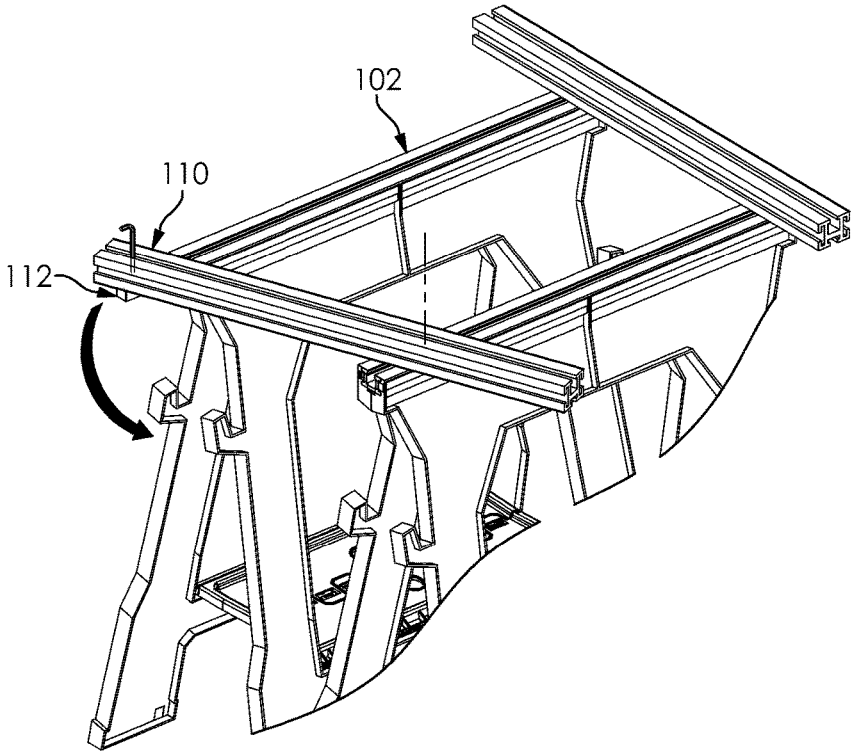
Figure 27:
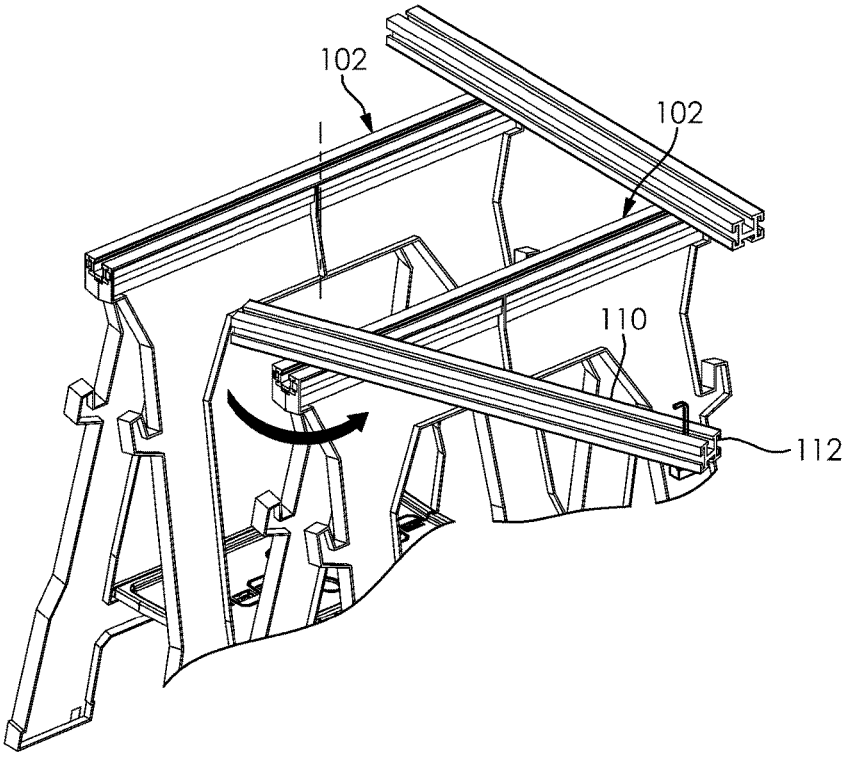
Figure 28:
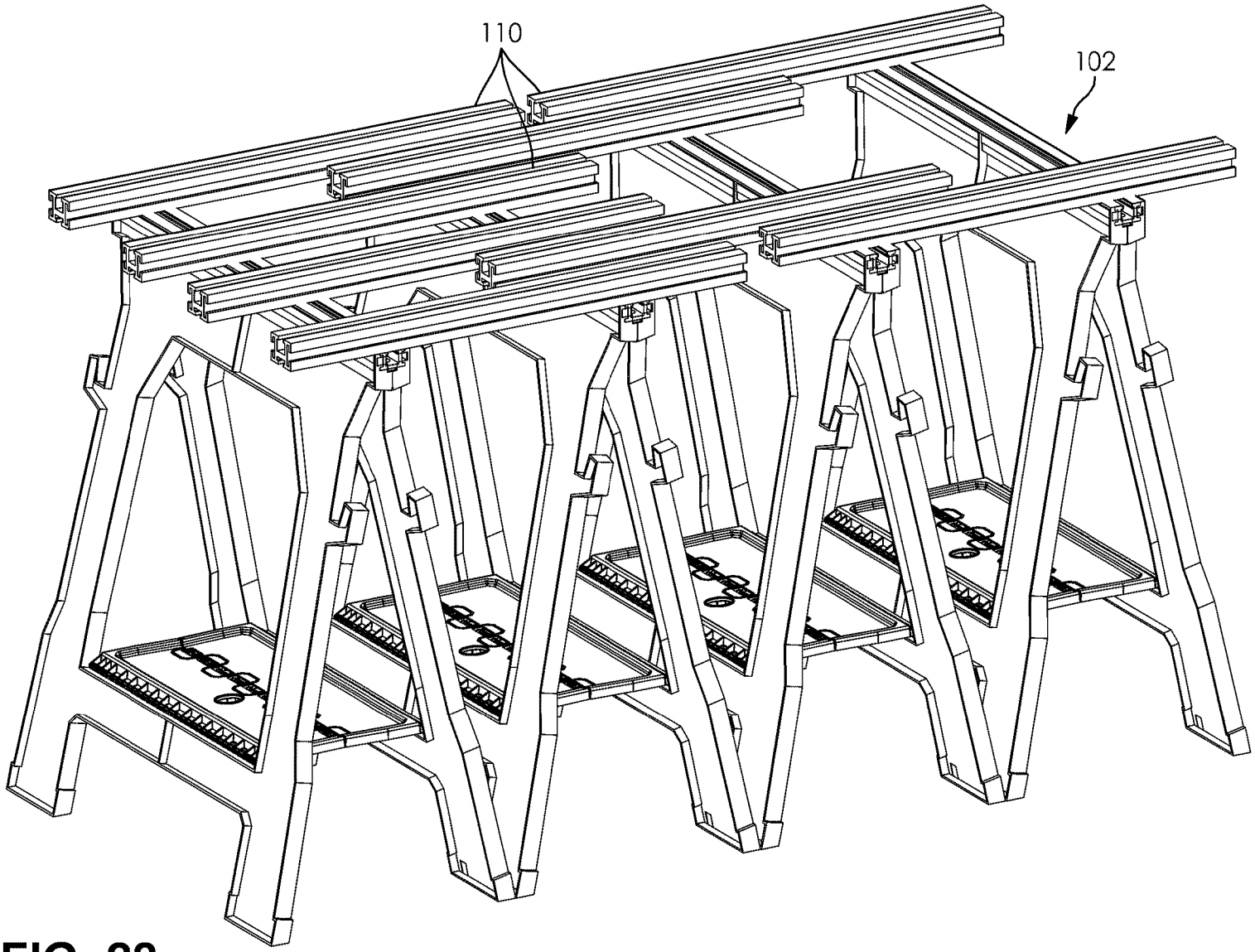

FIG. 25 is an enlarged perspective view showing an end of a lower rail disposed inside of the support system of FIGS. 18-24, and further having slots on the sides that cooperate with clips of the support system to hold the lower rail inside of the support system FIG. 26 is an enlarged perspective view of the plurality of support systems shown in FIG. 18, with a rotatable rail shown disengaging from one support system and a directional arrow showing the rail rotating toward a position for engagement with another support system;

FIG. 27 is an enlarged perspective view of the plurality of support systems shown in FIG. 25, with a directional arrow showing the rotatable rail rotated to the position for engagement with the another support system; and FIG. 28 is a perspective view showing a plurality of the support systems as shown in FIG. 18 a further embodiment of the present disclosure, the rotatable rails of the support systems cooperating with different ones of the support systems to form a work surface.

DETAILED DESCRIPTION

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise described.

In FIGS. 1-17, a support system 2 according to one embodiment of the present disclosure is shown. Although the support system 2 is described primarily herein with respect to sawhorses, it should be appreciated that the support system 2 of the present disclosure can be used in any type of support structure such as, but not limited to, tables, work benches, desks, and the like. Similarly, although the support system 2 is described herein as being molded from a thermoplastic material, a skilled artisan may select any suitable material for the support system 2 as desired.

Figure 1:
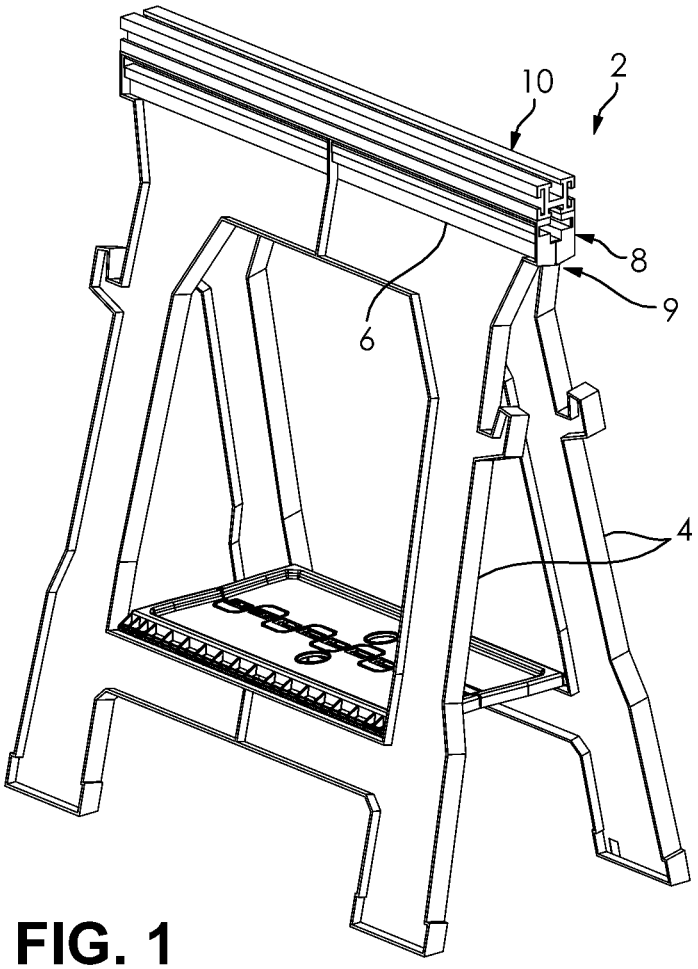
FIG. 1 is a perspective view of a support system with an integrated track according to one embodiment of the present disclosure, a rotatable rail slidably disposed within the track.
Figure 2:
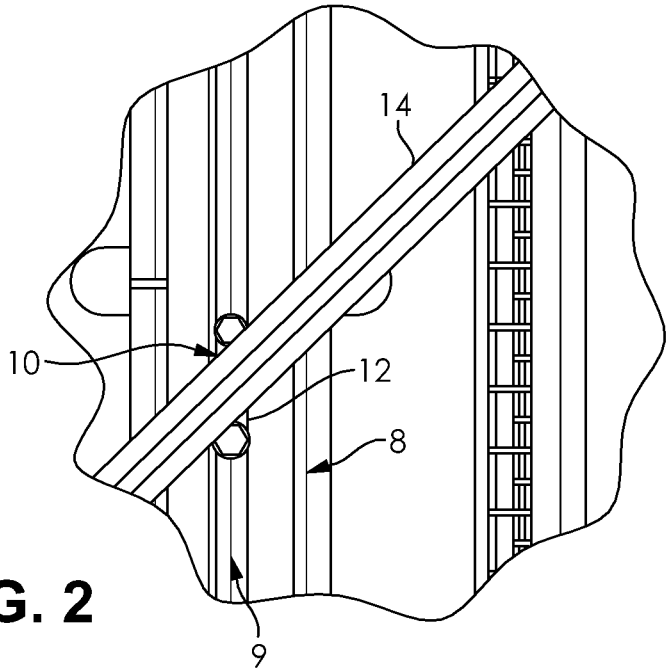
FIG. 2 is an enlarged top plan view of the support system shown in FIG. 1, with the rail rotated to show the underlying integrated track of the support system.

As shown in FIG. 1, the support system 2 has a plurality of legs 4 and a support portion 6. The support portion 6 contains an integrated track 8. For example, the integrated track 8 may be defined by an elongate cavity 9 disposed through a length of the support portion 6. The elongate cavity may be molded into the support portion 6 (shown in FIGS. 1-17), or can be defined by an insert (shown in FIGS. 18-29) disposed in the support portion 6, as desired.

In certain examples, the elongate cavity is substantially t-shaped in cross-section. In other examples, as shown in FIGS. 18-29, the elongate cavity may be substantially square or rectangular in shape. However, it should be understood that any suitable cross-sectional shape for the elongate cavity may be employed within the scope of the present disclosure.

Referring now to FIGS. 2-7, the integrated track 8 may receive a rotatable rail 10. The rotatable rail 10 as an insert portion 12 and a rotatable portion 14. The insert portion 12 is disposed in the elongate cavity of the integrated track 8. The rotatable portion 14 is disposed above the integrated track 8. The rotatable portion 14 is configured to rotate relative to the insert portion 12 of the rotatable rail 10.

Figure 3:
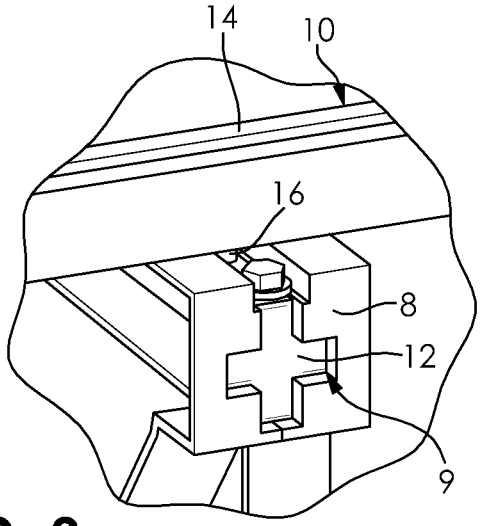
FIG. 3 is an enlarged perspective view of the support system shown in FIG. 1, depicting an end of the integrated track and a slidable cooperation of the rotatable rail within the track.

The overall shape of the insert portion 12 may generally correspond to the cross-sectional shape of the cavity of the elongate track 8. For example, as shown in FIG. 3, where the cavity is substantially t-shaped in cross-section, the insert portion 12 may also be substantially t-shaped. In any case, the overall shape of the insert portion 12 permits the insert portion 12, and thereby the rotatable rail 10, to be selectively slid back and forth inside of the elongate integrated track 8, as desired.

Figure 4:
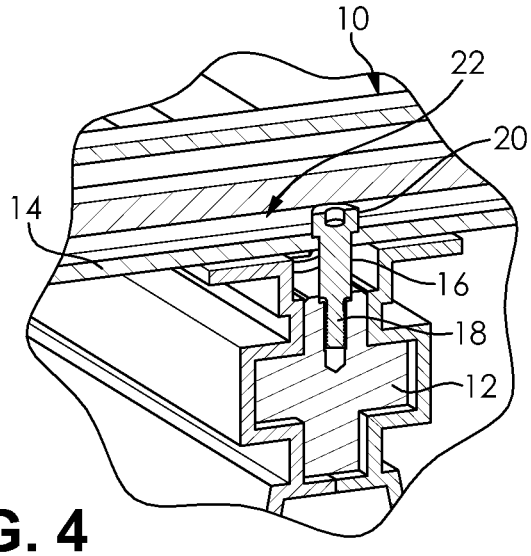
FIG. 4 is a cross-sectional perspective view of the support system shown in FIG. 3, depicting a pin connecting an insert portion and a rotatable portion of the rotatable rail.

With reference to FIGS. 3-4, the insert portion 12 and the rotatable portion 14 of the rail 10 may be connected with a pin 16. As shown in FIG. 4, the pin 16 may have a threaded first end 18 that cooperates with a threaded hole in the insert portion 12. The pin 16 may also have a head at a second end 20 of the pin 16 that sits within a lower channel 22 of the rotatable portion 14 of the rail 10. The rotatable portion 14 is thereby rotatably secured to the insert portion 12 of the rotatable rail 10.

Figure 5:
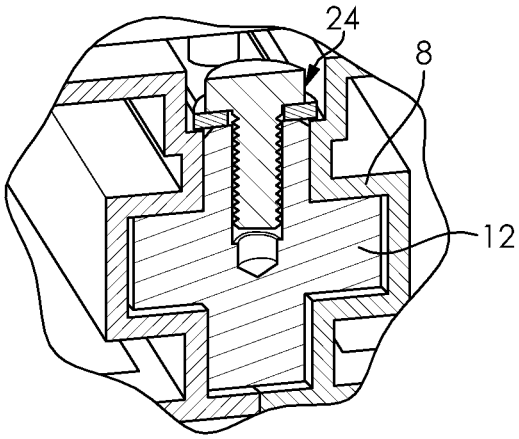
FIG. 5 is an enlarged cross-sectional perspective view of the insert portion of the rotatable rail shown in FIG. 4.
Figure 6:
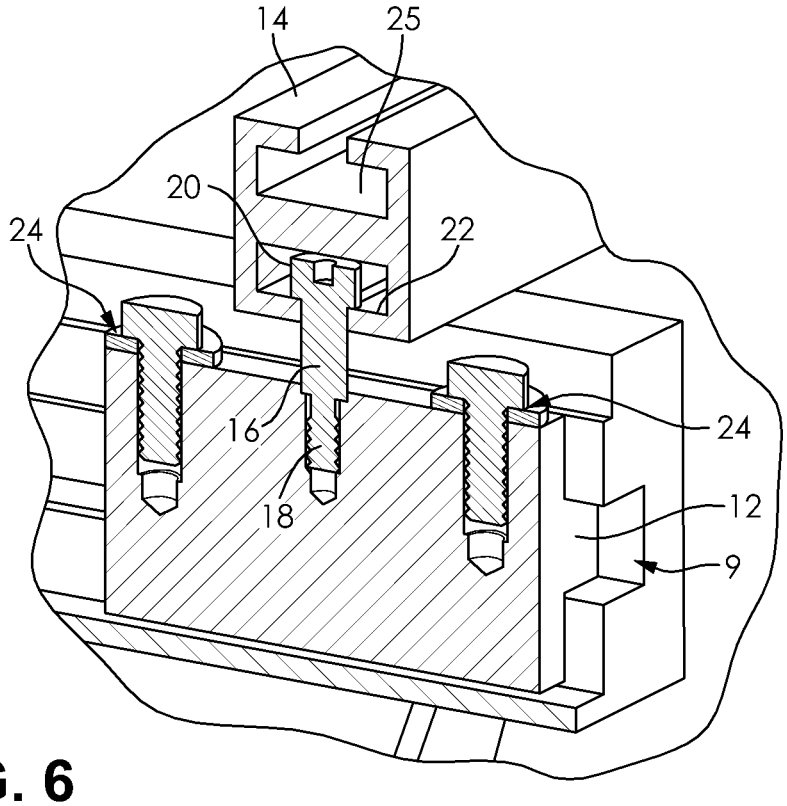
FIG. 6 is a cross-sectional perspective view of the support system shown in FIG. 3, further depicting a placement of the insert portion of the rotatable rail within the integrated track of the support system.
Figure 7:
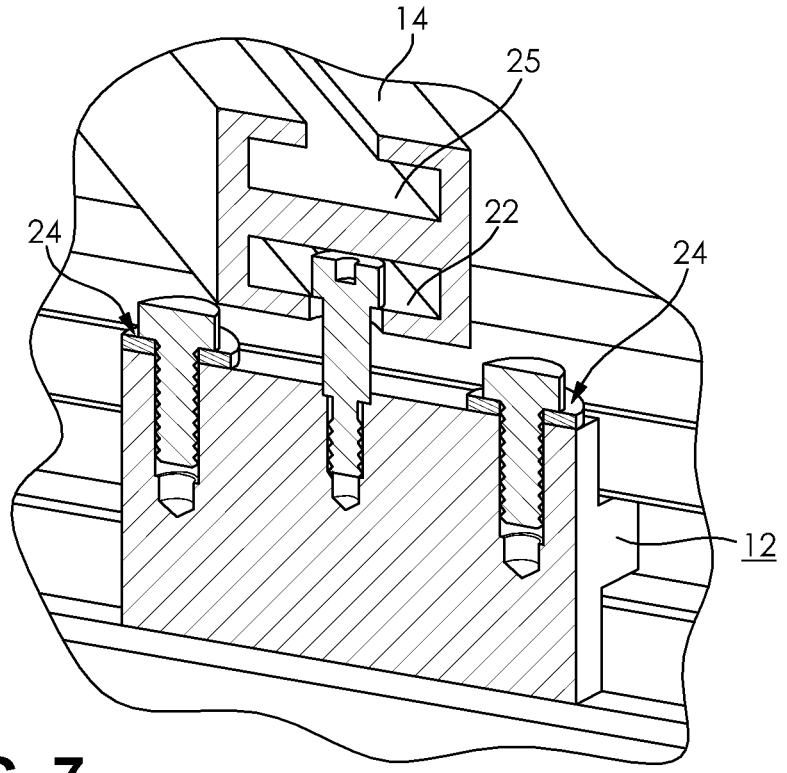
FIG. 7 is a cross-sectional perspective view of the support system shown in FIG. 6, with the rotatable portion of the rotatable rail rotated to a different location.

With reference to FIGS. 5-7, the insert portion 12 may be slid into the integrated track 8 at an end of the support system 2. Thereafter, following a positioning of the insert portion 12 along the length of the integrated track 8, the insert portion 12 may be fixed in place through the tightening of a bolt or screw and washer assembly 24. As the bolt or screw is tightened, the washer impinged upon an upper surface of the integrated track 8, resulting in a mechanical affixing of the insert portion 12 of the rotatable rail 10 to the integrated track 8. As shown in FIGS. 6-7, the insert portion 12 may have a plurality of the tightening assemblies 24, as desired. It should also be appreciated that other suitable types and configurations of tightening assemblies 24 may also be used within the scope of the present disclosure.

Figure 8:
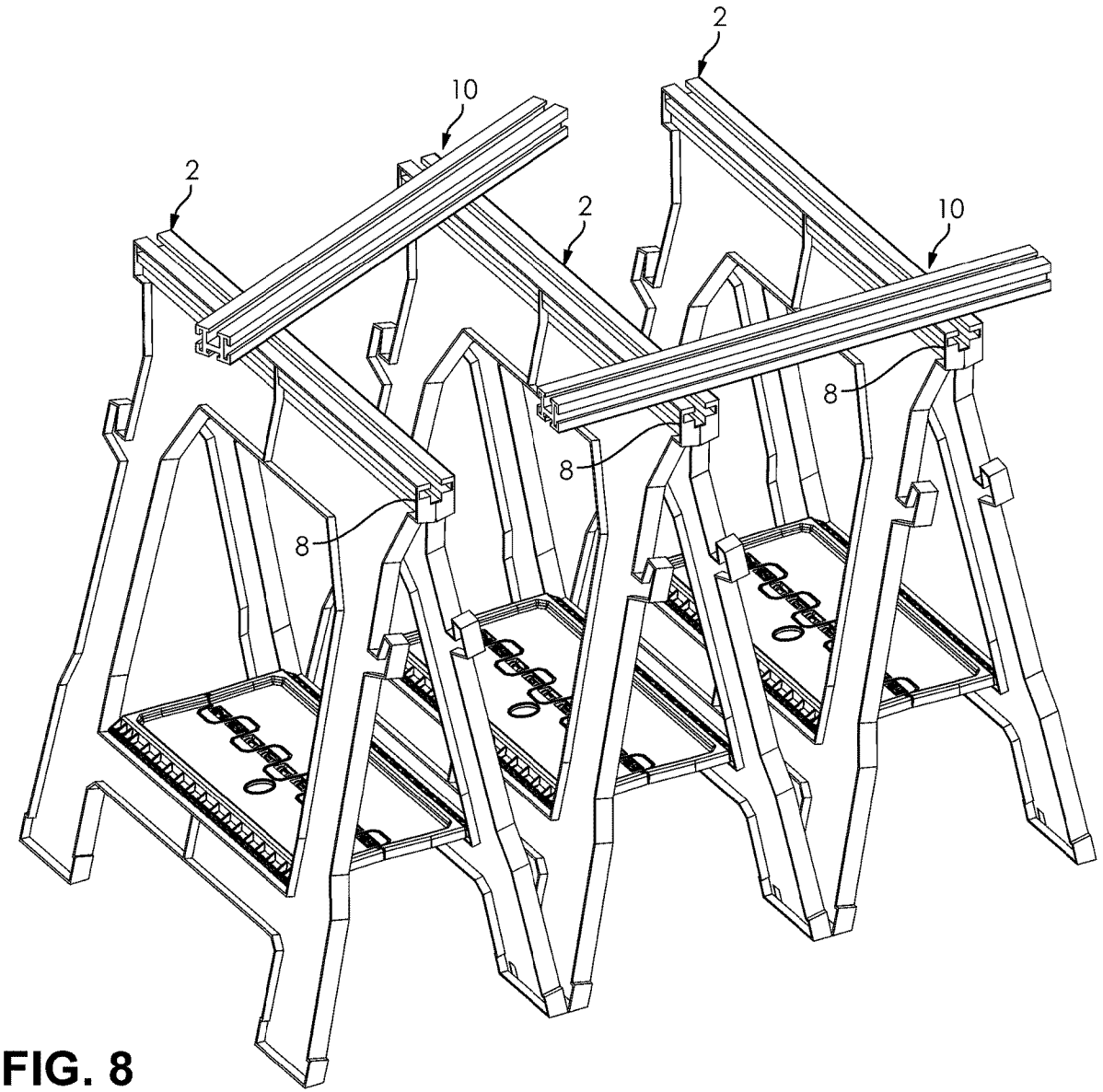
FIG. 8 is a perspective view showing a plurality of the support systems depicted in FIGS. 1-7, the rotatable rails of the support systems cooperating with different ones of the support systems to form a work surface.
Figure 9:
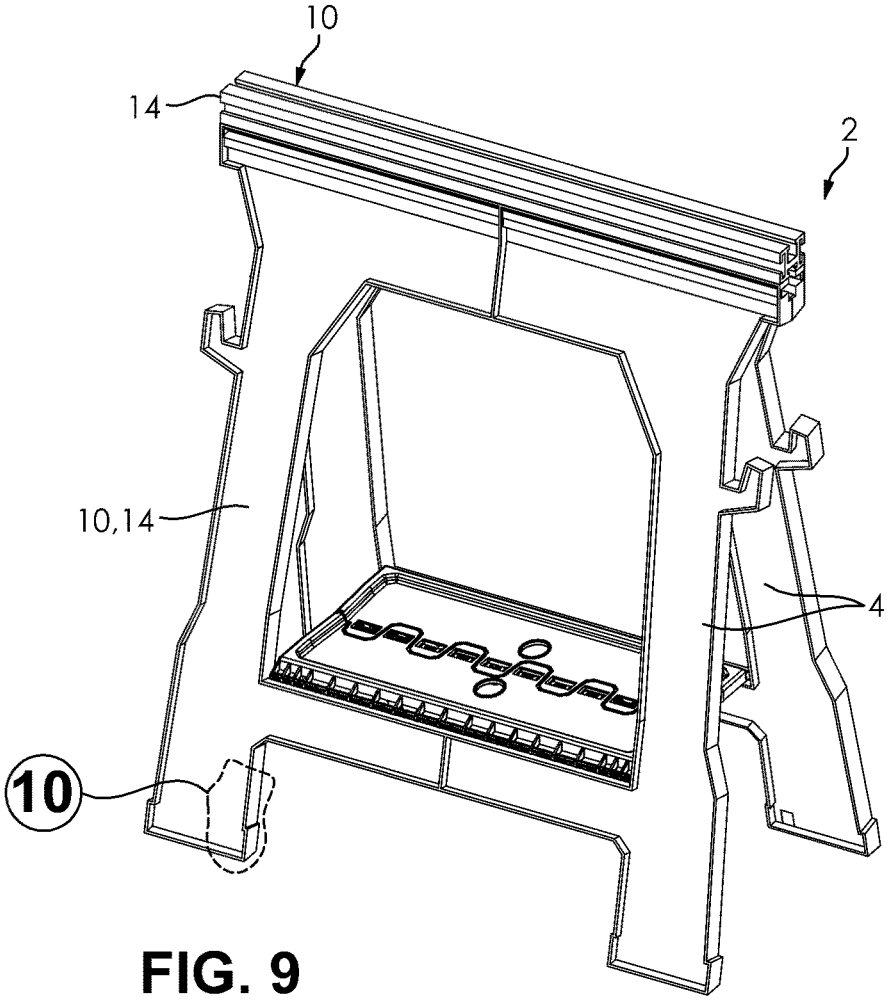
FIG. 9 is a perspective view of a support system with an integrated track according to another embodiment of the present disclosure, the rotatable rail received by a leg of the support system for storage or transport.
Figure 10:
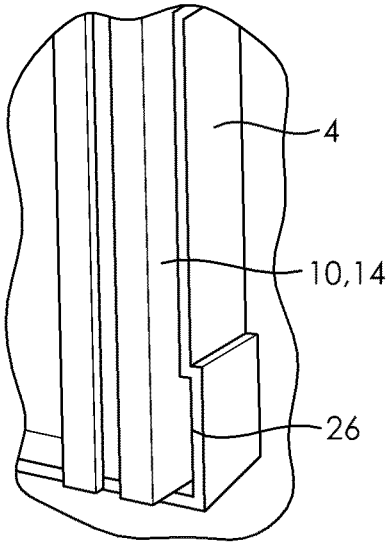
FIG. 10 is an enlarged perspective view a bottom of the leg of the support system taken at callout 10 in FIG. 9.

As illustrated in FIG. 8, where a plurality of the support systems 2 are provided, the support systems 2 may be interconnected via the rotatable rails 10. In this manner, it should be understood that a variety of work surface shapes and sizes can be employed within the scope of the present disclosure.

With renewed reference to FIGS. 6-7, the rotatable portion 14 of each of the rotatable rails 10 may also be provided with an upper channel 25 that permits the rails 10 to be interlocked and stacked for purposes of transport and storage, or for the creation of different work surfaces disposed at different planes relative to each other.

Figure 11:
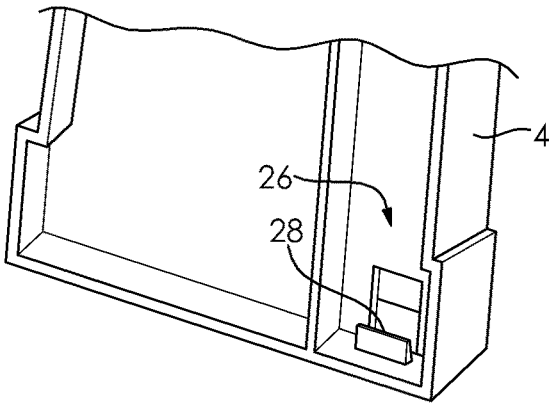
FIG. 11 is an enlarged perspective view of the leg of the support system shown in FIGS. 9 and 10, depicted with the rail removed to show the underlying attachment structure of the leg.
Figure 12:
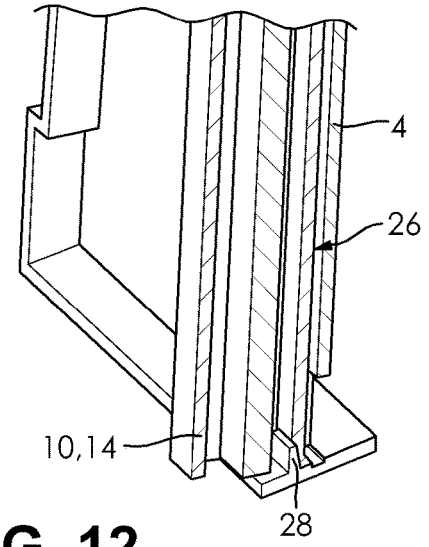
FIG. 12 is an enlarged cross-sectional view of the leg of the support system shown in FIGS. 9 and 10, depicting a cooperation of the rail with the underlying attachment structure of the leg.
Figure 13:
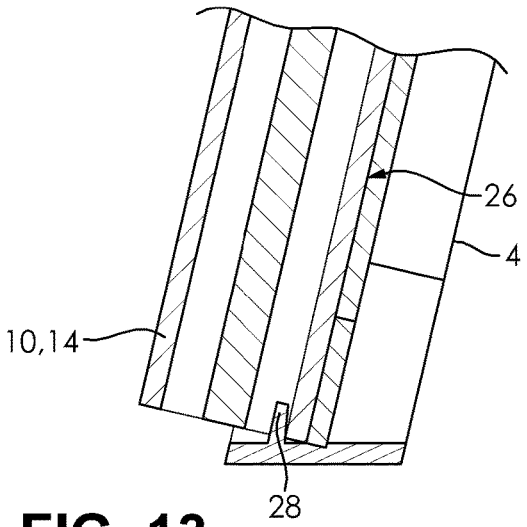
FIG. 13 is an enlarged cross-sectional side elevational view of the leg of the support system shown in FIG. 12.
Figure 14:
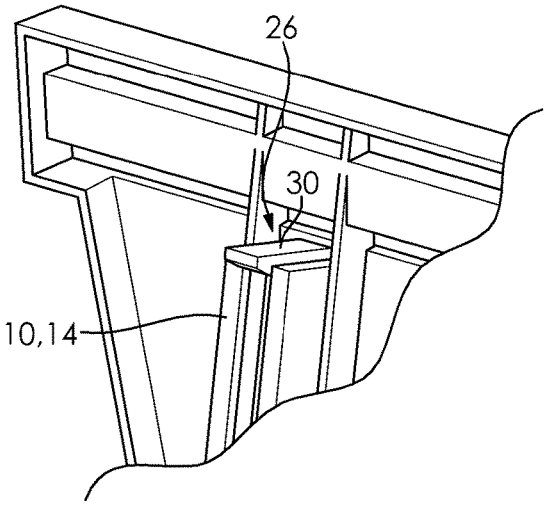
FIG. 14 is an enlarged perspective view a top of the leg of the support system shown in FIG. 9.
Figure 15:
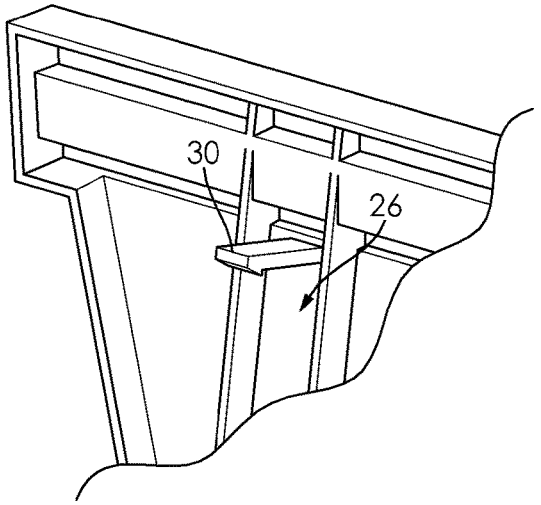
FIG. 15 is an enlarged perspective view of the leg of the support system shown in FIGS. 9 and 14, depicted with the rail removed to show the attachment structure of the leg.
Figure 16:
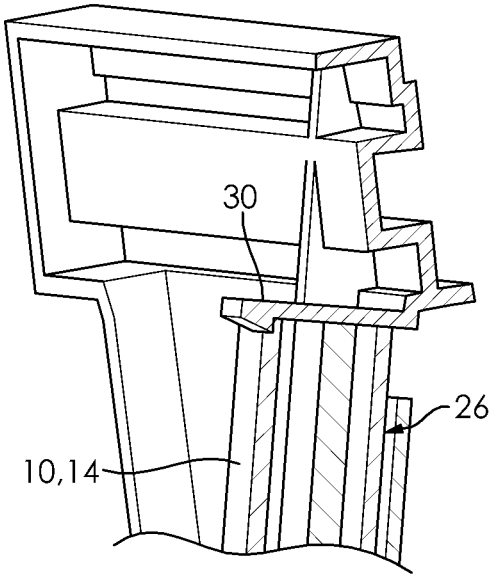
FIG. 16 is an enlarged cross-sectional perspective view of the leg of the support system shown in FIG. 15.
Figure 17:
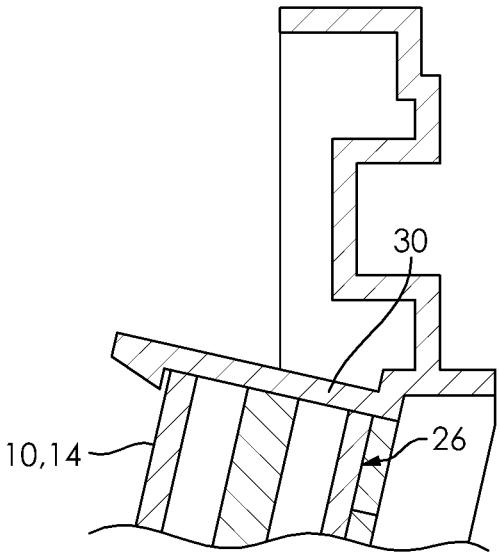
FIG. 17 is an enlarged cross-sectional side elevational view of the leg of the support system shown in FIG. 16.

As shown in FIGS. 9-17, it should be understood that the support system 2 may be configured to permit the storage of the rotatable portion 14 of the rotatable rails 10 in the legs 4 of the support system 2. For example, at least one of the legs 4 may have a recess 26 that is configured to receive the rotatable portion 14 of the rail 10 for storage or transport. The recess 26 of the leg 4 also has at least one attachment structure 28, 30 configured to removably secure the rotatable portion 14 of the rail 10 to the leg 4. The attachment feature 28 may include a tab that cooperates with a channel of the portion 14 of the rail 10 to selectively hold one end of the rail 10 within the recess 26, for example, as illustrated in FIGS. 11-13. The attachment feature 30 may include an clip extending outwardly from the recess 26 that selectively holds another end of the rail 10 within the recess, for example, as illustrated in FIGS. 14-17. Other means for selectively holding the portion 14 of the rail 10 within the recess 26 for storage or transport may also be employed, as desired.

Although not shown herein, it should be appreciated that a variety of work implements such as clamps, tools, power tooling, tool holders, etc. may be secure adjacent to the work surface via at least one of the integrated track 8 and the rail 10. Particular implements have attachment features configured to cooperate with either the elongate cavity of the integrated track 8, or the channel formed in the rail 10, as desired. One of ordinary skill in the art may select suitable types of work implements and attachment features within the scope of the present disclosure.

A support system 102 according to another embodiment of the present disclosure is shown in FIGS. 18-28. Like or related structure relative to FIGS. 1-17, and shown in FIGS. 18-28, is identified by the same number in a 100 series for purpose of clarity.

The support system 102 includes a plurality of legs 104 and a support portion 106. The support portion 106 contains an integrated track 108. As shown in FIGS. 18-28, the integrated track 108 is defined by an elongate cavity 109 that is defined by an insert 111 disposed in the support portion 106. With reference to FIG. 25, the insert 111 may be selectively held in place by fasteners 113 such as clips disposed at the ends of the integrated track 108. The insert 111 may be formed from a metal, a plastic, a composite, or any other suitable material, as desired.

The support system 102 further includes a rotatable rail 110. As shown in FIGS. 20-24, the rotatable rail 110 has an insert portion 112 and a rotatable portion 114. The insert portion 112 is disposed in the elongate cavity 109 of the integrated track 108. The rotatable portion 114 is disposed above the integrated track 108. The rotatable portion 114 is configured to rotate relative to the insert portion 112 of the rotatable rail 110.

As depicted in FIGS. 20-24, the rotatable portion 114 includes a rotating body 115. The rotating body 115 may be rotatably connected to the insert portion 112 via a pin 116, and may also be disposed in a channel 117 of a main body of the rotatable rail 110 to connect the insert portion 112 and the rotating portion 114 of the rotatable rail 110.

As also shown in FIGS. 20-24, the support system 102 may be provided with a wrench 132. The wrench 132 may be configured to engage the head of the pin 116 through a chancel formed in the rotatable rail 110, to thereby selectively tighten the pin 116 and lock the rotatable rail 110 into a desired position.

In operation, as illustrated in FIGS. 26-28, the insert portion 112 of the rotatable rail 110 may be disengaged from the support portion 106 of the support system 102, for example, by loosening the pin 116. This allows the rotatable rail 110 to be slid out from the integrated track 108 and freely rotated from one position to another position, where the rotatable rail 110 may be engaged with the support portion 6 of another support system 102, for example, as shown in FIG. 28. In this manner, multiple support systems 102 may be used in combination and connected to define a work surface, as desired.

Advantageously, the support system 2, 102, such as a pre-formed sawhorse, with the integrated track 8, 108 facilitates a more efficient connecting of multiple support systems 2, 102 to form work surfaces of different sizes and shapes. The support system 2, 102 with the integrated track 8, 108 as described hereinabove is easily storable, and also permits the use of a variety of work implements as described.

While certain representative embodiments and details have been shown for purposes of illustrating the invention, it will be apparent to those skilled in the art that various changes may be made without departing from the scope of the disclosure, which is further described in the following appended claims.

What is claimed is:

1. A support system, comprising:

a main body having a plurality of legs attached to a support portion, the support portion having an integrated track disposed therein, and the integrated track including an elongate cavity formed along a length of the support portion;

an insert disposed in the elongate cavity and selectively slidably movable along the length of the elongate cavity;

a rotatable rail having an elongate upper channel and an elongate lower channel, each of the elongate upper channel and the elongate lower channel formed along a length of the rotatable rail from one end of the rotatable rail to another end of the rotatable rail, the elongate upper channel formed in an uppermost surface of the rotatable rail and the elongate lower channel formed in a lowermost surface of the rotatable rail;

a pin with a first end and a second end, the first end connected to the insert, and the second end having a head that is disposed in the elongate lower channel of the rotatable rail, wherein the rotatable rail is rotatably secured to the insert and rotatable about the head of the pin; and at least one tightening assembly disposed on the insert for selectively securing the insert at a position within the elongate cavity of the integrated track, the at least one tightening assembly includes one of a bolt and washer assembly and a screw and washer assembly connected to the insert and configured to selectively secure the insert at the position upon being tightened and to selectively permit for slidable movement of the insert upon being loosened.

2. The support system of claim 1, wherein the elongate cavity of the integrated track is either molded into the support portion or defined by an insert disposed in the support portion.

3. The support system of claim 1, wherein the elongate cavity is substantially t-shaped in cross-sectional shape.

4. The support system of claim 1, wherein the elongate cavity is substantially square or rectangular in cross-sectional shape.

5. The support system of claim 1, wherein the insert has a shape that corresponds to a cross-sectional shape of the elongate channel.

6. The support system of claim 1, wherein the first end of the pin is threadably engaged with a threaded hole formed in the insert.

7. The support system of claim 1, wherein at least one of the legs of the main body has a recess configured to receive the rotatable rail for storage or transport.

8. The support system of claim 7, wherein the at least one recess includes at least one attachment feature configured to removably secure the rotatable rail in the recess.

9. The support system of claim 8, wherein the at least one attachment feature includes at least one of a tab and a clip.

* * * * *